US011127555B1

(12) United States Patent
Ide et al.

(10) Patent No.: US 11,127,555 B1
(45) Date of Patent: Sep. 21, 2021

(54) FUSE

(71) Applicant: TOYODA IRON WORKS CO., LTD., Toyota (JP)

(72) Inventors: Hiroki Ide, Toyota (JP); Kunihiro Iwata, Toyota (JP)

(73) Assignee: TOYODA IRON WORKS CO., LTD., Toyota (JP)

( * ) Notice: Subject to any disclaimer, the term of this patent is extended or adjusted under 35 U.S.C. 154(b) by 0 days.

(21) Appl. No.: 17/184,449

(22) Filed: Feb. 24, 2021

(30) Foreign Application Priority Data

May 14, 2020 (JP) ..... JP2020-085256

(51) Int. Cl.

| | |
|---|---|
| ***H01H 85/175*** | (2006.01) |
| ***H01H 85/143*** | (2006.01) |
| ***H01H 85/10*** | (2006.01) |
| *H01H 85/18* | (2006.01) |

(52) U.S. Cl.
CPC ..... *H01H 85/1755* (2013.01); *H01H 85/10* (2013.01); *H01H 85/143* (2013.01); *H01H 85/175* (2013.01); *H01H 85/18* (2013.01)

(58) Field of Classification Search
CPC ..... H01H 69/02; H01H 85/10; H01H 85/143; H01H 85/165; H01H 85/17; H01H 85/175; H01H 85/1755; H01H 85/18; H01H 85/38
See application file for complete search history.

(56) References Cited

U.S. PATENT DOCUMENTS

| | | | | |
|---|---|---|---|---|
| 3,601,737 | A * | 8/1971 | Baird | H01H 85/055 337/159 |
| 5,296,832 | A * | 3/1994 | Perreault | H01H 85/153 337/158 |
| 5,357,234 | A * | 10/1994 | Pimpis | H01H 85/153 337/246 |
| 5,854,583 | A * | 12/1998 | Falchetti | H01H 85/044 337/290 |
| 6,160,471 | A * | 12/2000 | Rybka | H01H 85/055 337/273 |
| 2010/0102920 | A1* | 4/2010 | Stanek | H01H 85/0013 337/186 |
| 2015/0294828 | A1* | 10/2015 | Burge | H01H 85/38 337/274 |
| 2016/0141140 | A1* | 5/2016 | Schmidt | H01H 85/38 337/187 |

(Continued)

FOREIGN PATENT DOCUMENTS

JP 2018-129309 A 8/2018

*Primary Examiner* — Jacob R Crum

(57) ABSTRACT

A fuse includes a fuse element extending along an axis, the fuse element including two terminals and a melt portion arranged between the two terminals, a casing that accommodates the melt portion and an arc-extinguishing material, the casing including an outer circumferential surface and two end surfaces, the casing being an assembly of at least two segments, and a molded body made of plastic, the molded body including two covers that respectively cover the two end surfaces and including one or more coupling portions that couple the two covers to each other, the two covers and the one or more coupling portions being integrally molded. The casing includes one or more exposed portions on the outer circumferential surface, the one or more exposed portions being exposed without being covered by the coupling portions.

5 Claims, 7 Drawing Sheets

(56) References Cited

U.S. PATENT DOCUMENTS

| | | | | |
|---|---|---|---|---|
| 2016/0268089 | A1* | 9/2016 | Schlaak | H01H 85/185 |
| 2018/0174791 | A1* | 6/2018 | Kawai | H01H 85/185 |
| 2020/0090893 | A1* | 3/2020 | Leung | H01H 85/175 |
| 2020/0234906 | A1* | 7/2020 | Rosios | H01H 85/175 |

* cited by examiner

FUSE

BACKGROUND

1. Field

The present disclosure relates to a fuse.

2. Description of Related Art

Japanese Laid-Open Patent Publication No. 2018-129309 discloses a fuse used in, for example, an electric circuit for an automobile. The fuse includes a fuse element, a tubular casing that accommodates the fuse element, two caps, and two holding plates. The casing includes two openings at the opposite ends. The fuse element includes two terminals, which protrude in opposite directions, and a melt portion, which is arranged between the two terminals. Each terminal protrudes from the corresponding opening of the casing. Each terminal includes a contact piece. Two holding plates hold the opposite ends of the fuse element, respectively. The holding plates are inserted between the opening edges and the contact pieces of the casing. Each cap closes the corresponding opening of the casing so as to cover the outer circumferential surface of the casing and the holding plates. The casing accommodates an arc-extinguishing material.

When overcurrent flows through the electric circuit including such a fuse, the overcurrent melts the melt portion of the fuse element with Joule heat. Braking the electric circuit in this manner protects the electric circuit.

The melting of the melt portion produces an impact force. In the above-described fuse, such an impact force may remove the caps from the casing.

SUMMARY

It is an objective of the present disclosure to provide a fuse that prevents the separation of a casing.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

A fuse according to an aspect of the present disclosure includes a fuse element extending along an axis, the fuse element including two terminals and a melt portion arranged between the two terminals, a casing that accommodates the melt portion and an arc-extinguishing material, the casing including an outer circumferential surface and two end surfaces, the casing being an assembly of at least two segments, and a molded body made of plastic, the molded body including two covers that respectively cover the two end surfaces and including one or more coupling portions that couple the two covers to each other, the two covers and the one or more coupling portions being integrally molded. The casing includes one or more exposed portions on the outer circumferential surface, the one or more exposed portions being exposed without being covered by the coupling portions.

Other features and aspects will be apparent from the following detailed description, the drawings, and the claims.

BRIEF DESCRIPTION OF THE DRAWINGS

FIG. 5 is an exploded perspective view showing the internal structure of the fuse in

FIG. 4.

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

First Embodiment

A fuse according to a first embodiment will now be described with reference to FIGS. 1 to 3.

Figure 1:
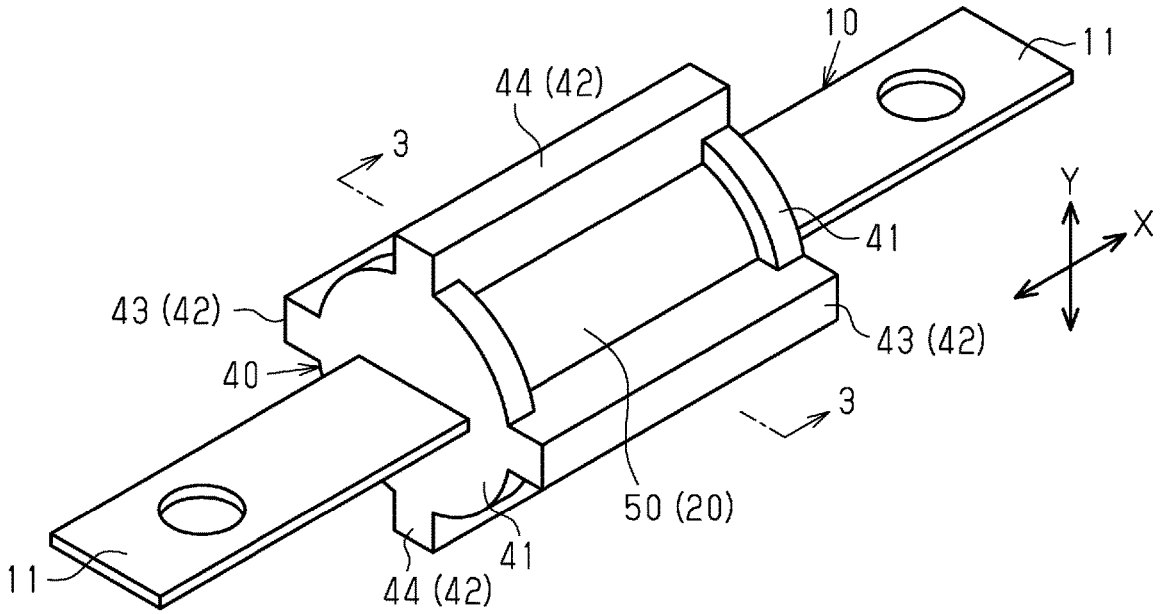
FIG. 1 is a perspective view showing a fuse according to a first embodiment.
Figure 2:
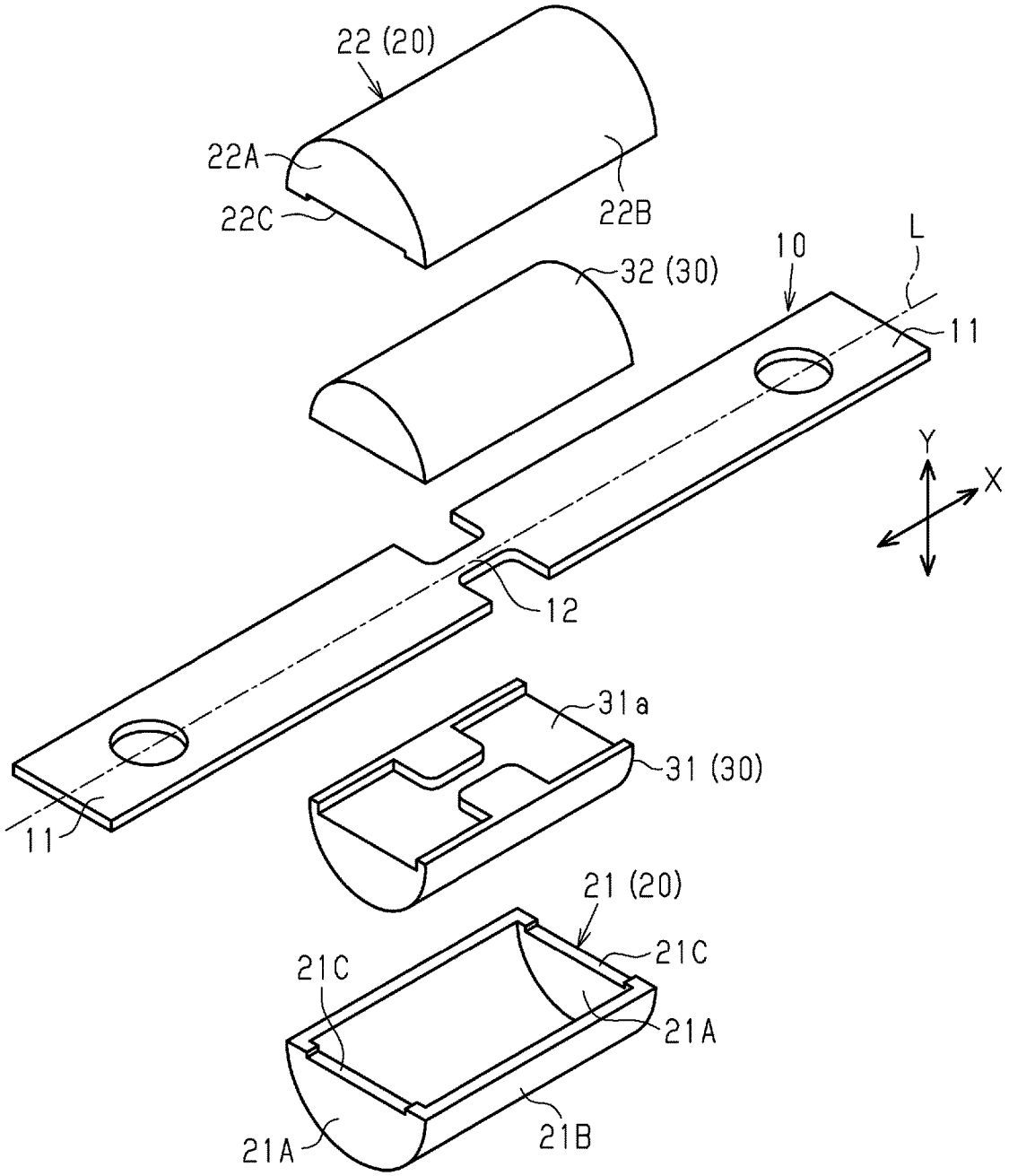
FIG. 2 is an exploded perspective view showing the internal structure of the fuse in FIG. 1.
Figure 3:
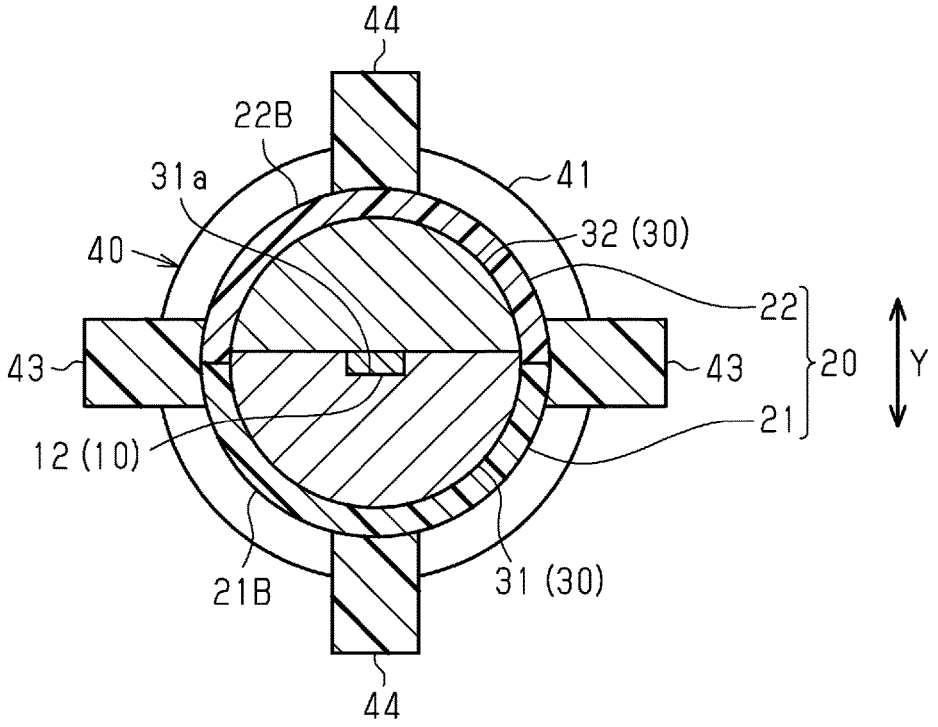
FIG. 3 is a cross-sectional view taken along line 3-3 in FIG. 1.

As shown in FIGS. 1 to 3, the fuse includes a fuse element 10, a casing 20, an arc-extinguishing material 30, and a molded body 40. The fuse element 10 has an elongated shape. The fuse element 10 has an axis L (refer to FIG. 2), which extends along the X-axis. The Y-axis is orthogonal to the X-axis. The X-axis indicates an extending direction X, in which the fuse element 10 extends. That is, the X-axis indicates the longitudinal direction of the fuse element 10.

The fuse element 10 includes two terminals 11, which extend in opposite directions along the axis L, and a melt portion 12, which is arranged between the two terminals 11. The melt portion 12 has a smaller width than the two terminals 11. The fuse element 10 is made of, for example, copper or copper alloy.

The casing 20 is hollow and tubular. The casing 20 includes an outer circumferential surface, which extends along the axis L, and two end surfaces, which intersect the axis L. The casing 20 is an assembly of at least two segments, including an outer shape in which the outer circumferential surface and the two end surfaces are split by a split surface that includes the axis L. The "at least two segments" may refer to a first casing member 21 and a second casing member 22, which are split by the split surface. The direction in which the casing members 21, 22 are laid out is referred to as a split direction Y (up-down direction in FIGS. 1 to 3).

As shown in FIG. 2, the first casing member 21 includes two semicircular end walls 21A and a circumferential wall 21B, which extends between the two end walls 21A. The straight edge of each end wall 21A includes a recess 21C.

The second casing member 22 is shaped in the same manner as the first casing member 21. The second casing member 22 includes two end walls 22A, a circumferential wall 22B, and two recesses 22C. The coupling of the casing members 21, 22 causes the recesses 21C and the recesses 22C to define rectangular openings.

The first casing member 21 and the second casing member 22 are made of thermoplastic. The first casing member 21 and the second casing member 22 may be made of thermosetting plastic. The coupling of the casing members 21, 22 causes the end walls 21A, 22A that are first ends of the casing members 21, 22 in the extending direction X to become a first circular end surface of the casing 20 and causes the end walls 21A, 22A that are second ends of the casing members 21, 22 in the extending direction X to become a second circular end surface of the casing 20.

As shown in FIGS. 2 and 3, the casing 20 accommodates the melt portion 12 of the fuse element 10. The terminals 11 protrude outward from the casing 20 through the openings defined by the recesses 21C, 22C, respectively.

The arc-extinguishing material 30 is accommodated in the casing 20. The arc-extinguishing material 30 includes a first portion 31 and a second portion 32. The first portion 31 and the second portion 32 are shaped by splitting a solid column extending along the axis L into two by the split surface including the axis L. The first portion 31 is accommodated in the first casing member 21. The second portion 32 is accommodated in the second casing member 22. The first portion 31 includes a rectangular cut surface, which is opposed to the fuse element 10, and a recess 31*a*, which opens in the cut surface. The fuse element 10 is arranged in the recess 31*a*. The recess 31*a* is shaped in conformance with the melt portion 12 and the ends of the two terminals 11 connected to the melt portion 12.

As shown in FIGS. 1 and 3, the molded body 40 includes two circular covers 41. The two covers 41 cover the two end surfaces of the casing 20, respectively. In other words, the covers 41 cover the end walls 21A, 22A.

The molded body 40 includes one or more coupling portions 42, which couple the two covers 41 to each other. The two covers 41 and the coupling portions 42 are integrally molded. The "one or more coupling portions 42" may refer to multiple coupling portions 42 arranged at intervals in the circumferential direction around the axis L. The "one or more coupling portions 42" include, for example, two first coupling portions 43 and two second coupling portions 44.

The two coupling portions 43 respectively seal the section between the first ends of the casing members 21, 22 in the circumferential direction and the section between the second ends of the casing members 21, 22 in the circumferential direction. That is, the two first coupling portions 43 seal the section between the circumferential wall 21B and the circumferential wall 22B.

The two second coupling portions 44 cover parts of the outer circumferential surfaces of the casing members 21, 22, respectively. Each of the second coupling portions 44 is located between the two first coupling portions 43 in the circumferential direction. The two first coupling portions 43 protrude along the split surface toward the opposite sides in the radial direction. The second first coupling portions 44 protrude along the Y-axis toward the opposite sides in the radial direction. The first coupling portions 43 and the second coupling portions 44 are alternately arranged at intervals in the circumferential direction around the axis L.

The molded body 40 is made of thermoplastic.

The casing 20 includes one or more exposed portions 50 on the outer circumferential surface of the casing 20. The exposed portions 50 are exposed without being covered by the coupling portions 42. Each of the casing members 21, 22 includes one or more exposed portions 50. More specifically, each of the circumferential wall 21B and the circumferential wall 22B includes two exposed portions 50 that are not covered by the coupling portions 42.

The molded body 40 is molded with the following procedure.

First, the first portion 31 is accommodated in the first casing member 21 so that the recess 31*a* of the first portion 31 accommodates the fuse element 10. The second portion 32 of the arc-extinguishing material 30 is mounted on the first casing member 21, the first portion 31, and the fuse element 10 nested in this manner. Subsequently, the second casing member 22 is layered on the second portion 32. This causes the space between the first casing member 21 and the second casing member 22 to accommodate the arc-extinguishing material 30 and the part of the fuse element 10 including the melt portion 12. Then, the assembly of the fuse element 10, the first casing member 21, the second casing member 22, and the arc-extinguishing material 30 is inserted into a mold (not shown) to inject molten resin into the cavity (not shown) in the mold. The resin in the mold is cooled to become plastic, thereby forming the plastic molded body 40. The parts of the outer circumferential surfaces of the casing members 21, 22 contacting the mold are the exposed portions 50.

The operation and advantages of the present embodiment will now be described.

(1) The two end surfaces of the casing 20 are covered by the two covers 41, respectively. This seals the gaps between the fuse element 10 and the casing 20. Further, the two covers 41 are coupled to each other by one or more coupling portions 42. This prevents the separation of the first casing member 21 from the second casing member 22 caused by an impact force that occurs during the melting of the melt portion 12. Accordingly, the casing 20 is prevented from being separated.

In addition, the casing 20 includes the exposed portions 50. Thus, the performance of releasing to the outside of the casing 20 the Joule heat produced in the casing 20 (i.e., the radiation performance of the casing 20) is higher than that of a comparative example in which the entire outer circumferential surface of the casing 20 is covered with plastic.

(2) Each of the casing members 21, 22 includes the exposed portions 50. This further increases the radiation performance of the casing 20.

Additionally, in the above-described structure, the casing 20 accommodating the melt portion 12 and the arc-extinguishing material 30 are inserted into the mold to injection-mold the molded body 40. The parts of the casing members 21, 22 contacting the mold during the injection-molding are the exposed portions 50. This allows the mold to support the casing members 21, 22 during the molding of the molded body 40 and thus prevents the first casing member 21 and the second casing member 22 from being separated from each other.

(3) Multiple coupling portions 42 are arranged at intervals in the circumferential direction around the axis L. This increases the rigidity of the molded body 40. Thus, the first casing member 21 and the second casing member 22 are further prevented from being separated from each other by an impact force produced when the melt portion 12 melts.

(4) The coupling portions 42 include two first coupling portions 43, which seal the section between the first casing member 21 and the second casing member 22. This prevents the arc-extinguishing material 30 from leaking out of the section between the first casing member 21 and the second casing member 22.

(5) In addition to the two first coupling portions 43, the molded body 40 includes two second coupling portions 44 and thus increases the rigidity of the molded body 40. This further prevents the first casing member 21 and the second casing member 22 from being separated from each other by an impact force produced when the melt portion 12 melts.

Second Embodiment

A second embodiment will now be described with reference to FIGS. 4 to 6, focusing on the differences from the first embodiment. Like or same reference numerals are given to those components of the present embodiment that are the same as the corresponding components of the first embodiment. Such components will not be described in detail.

Figure 4:
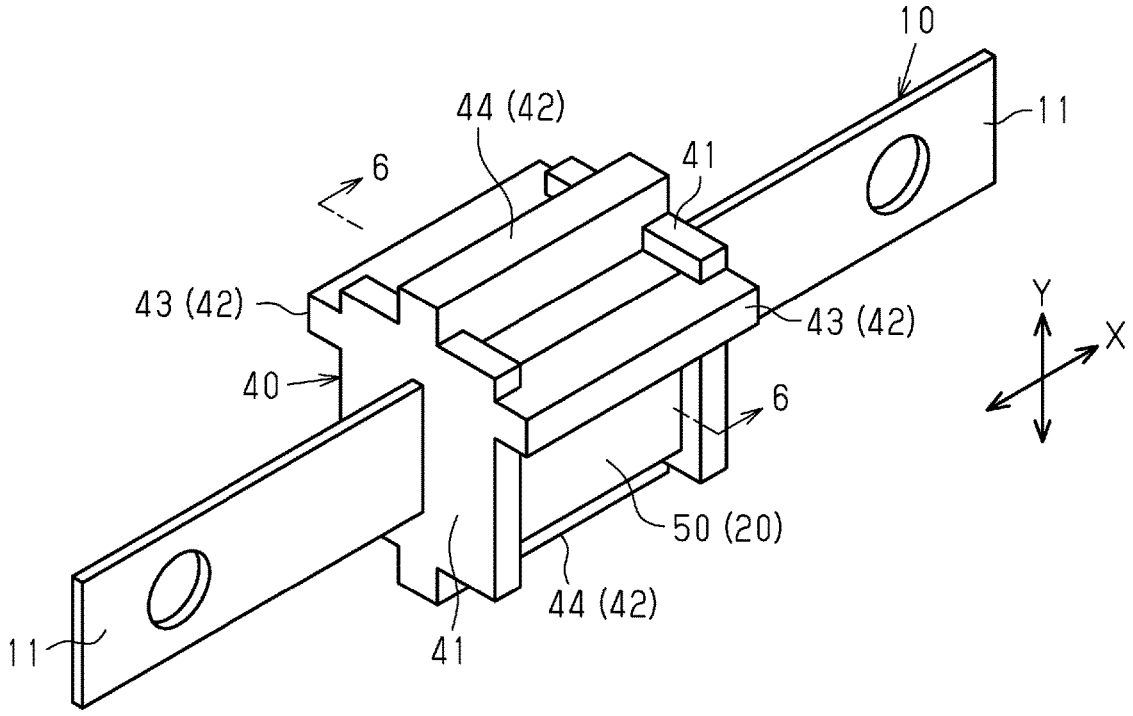
FIG. 4 is a perspective view showing the fuse according to a second embodiment.
Figure 5:
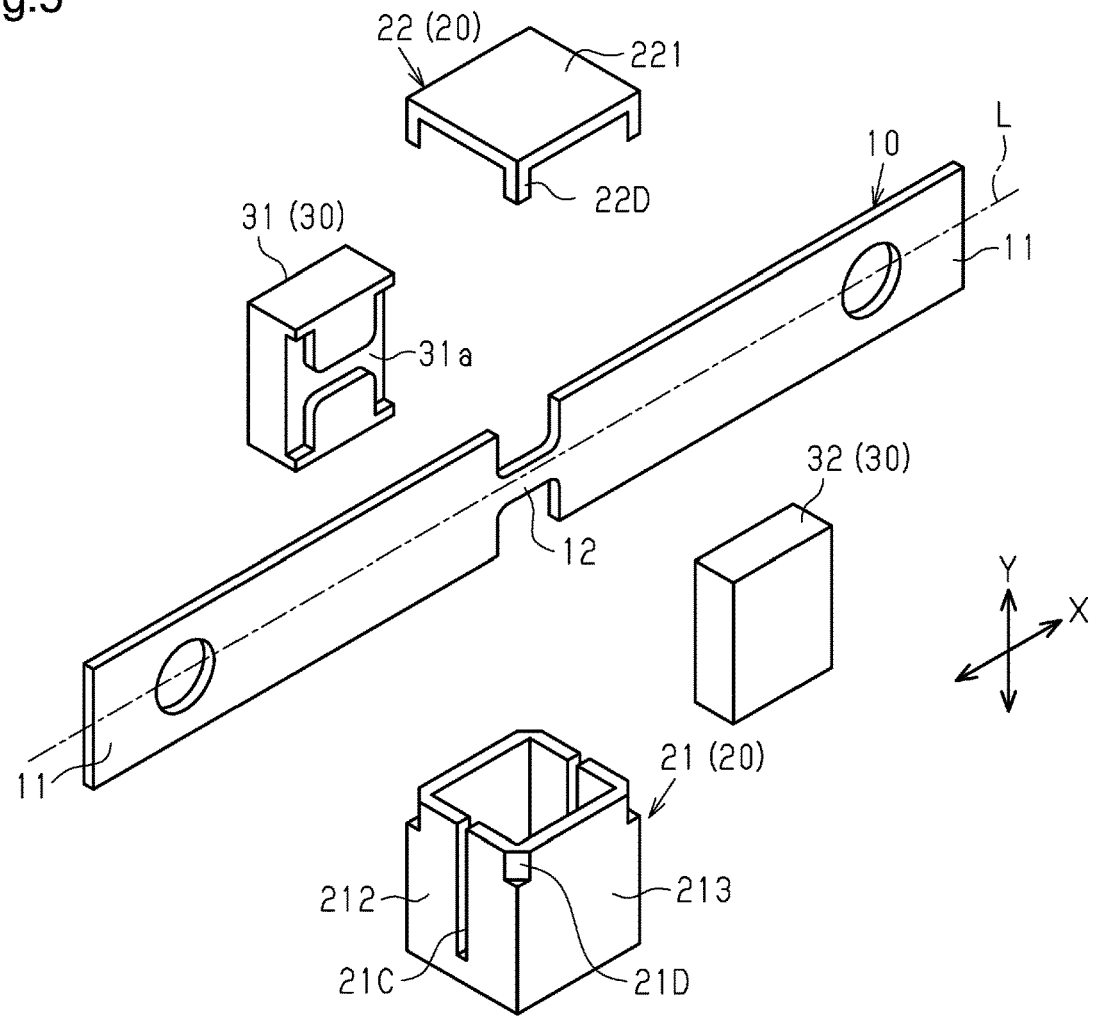
Figure 6:
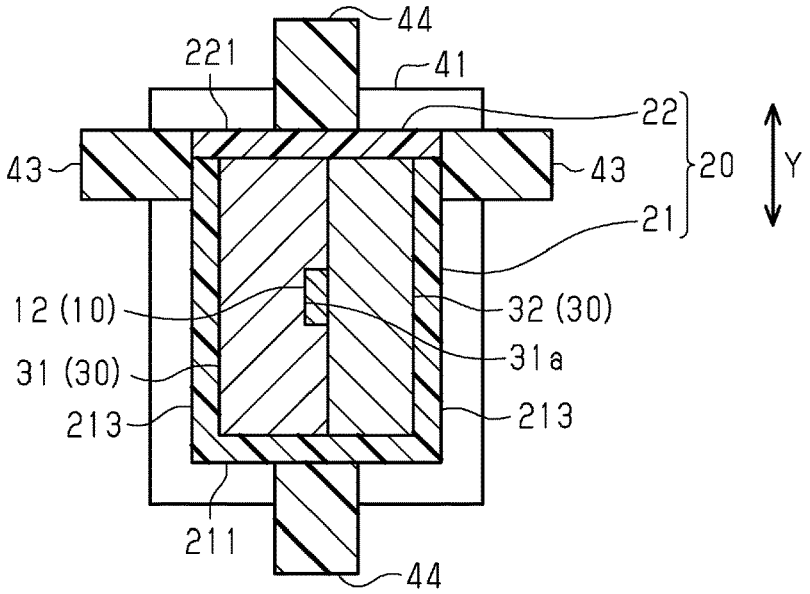
FIG. 6 is a cross-sectional view taken along line 6-6 in FIG. 4.

As shown in FIGS. 4 to 6, the fuse includes the fuse element 10, the casing 20, the arc-extinguishing material 30, and the molded body 40. The casing 20 is the assembly of the first casing member 21 and the second casing member 22, which are two segments.

As shown in FIG. 5, the casing 20 is a hollow cube.

As shown in FIGS. 5 and 6, the first casing member 21 is a box that opens in the direction orthogonal to the axis L (i.e., opens upward in FIG. 5) and includes an end wall 211, two side walls 212, and two side walls 213. The end wall 211 has the form of a rectangular plate. The two side walls 212 are opposed to each other. The two side walls 213 extend between first ends and second ends of the two side walls 212. Each side wall 212 includes a slit-shaped recess 21C, which extends along the Y-axis. Each of the four corners defined between the adjacent side walls 212, 213 include a chamfer 21D. The chamfers 21D are located at a region of the open end of the first casing member 21.

The second casing member 22 includes a top wall 221 and four legs 22D. The top wall 221 has the form of a rectangular plate and closes the opening of the first casing member 21. The four legs 22D protrude from the four corners of the top wall 221 toward the chamfers 21D, respectively.

Engaging each leg 22D with the corresponding chamfer 21D positions the first casing member 21 relative to the second casing member 22.

The width direction of the fuse element 10 extends along the Y-axis (i.e., extends in the direction in which the recess 21C extends).

The arc-extinguishing material 30 includes the first portion 31 and the second portion 32. The first portion 31 has a substantially cubic shape and is opposed to a first surface of the fuse element 10. The second portion 32 has a cubic shape and is opposed to a second surface of the fuse element 10, which is on the side opposite from the first surface. The recess 31*a*, which accommodates the fuse element 10, opens in the surface of the first portion 31 facing the fuse element 10. The recess 31*a* is shaped in conformance with the melt portion 12 and the ends of the two terminals 11 connecting to the melt portion 12.

As shown in FIGS. 4 and 6, the molded body 40 includes two covers 41, which have the form of a rectangular plate. Each cover 41 covers the outer surface of the corresponding side wall 212 and the outer surface of the top wall 221. That is, the two covers 41 cover the two end surfaces of the casing 20 intersecting the axis L, respectively.

The coupling portions 42 include two first coupling portions 43 and two second coupling portions 44. Each first coupling portion 43 seals the section between the corresponding side wall 212 and the top wall 221.

The parts of the outer circumferential surface of the casing 20 that are not covered by the coupling portions 42 (i.e., the parts of the outer surface of the end wall 211, the outer surface of the side walls 213, and the outer surface of the top wall 221 that are not covered by the coupling portions 42) are the exposed portions 50. Thus, the exposed portions 50 are arranged at the casing members 21, 22.

The present embodiment provides the same operational advantages as the operational advantages (1) to (5) of the first embodiment.

Modifications

The above-described embodiments may be modified as follows. The present embodiments and the following modifications can be combined as long as they remain technically consistent with each other.

Multiple second coupling portions 44 may be arranged between the two first coupling portions 43.

One or both of the two second coupling portions 44 may be omitted.

When the molded body 40 includes the second coupling portions 44, one or both of the first coupling portions 43 may be omitted. That is, the molded body 40 may include coupling portions 42 that do not seal the section between the first casing member 21 and the second casing member 22.

The molded body 40 simply needs to include at least one coupling portion 42.

The exposed portions 50 may be arranged at one of the casing members 21, 22. Further, at least one of the shape and size of each exposed portion 50 may be changed.

The split direction Y of the casing members 21, 22 simply needs to intersect the axis L (extending direction X) and does not have to be orthogonal to the axis L.

Figure 7:
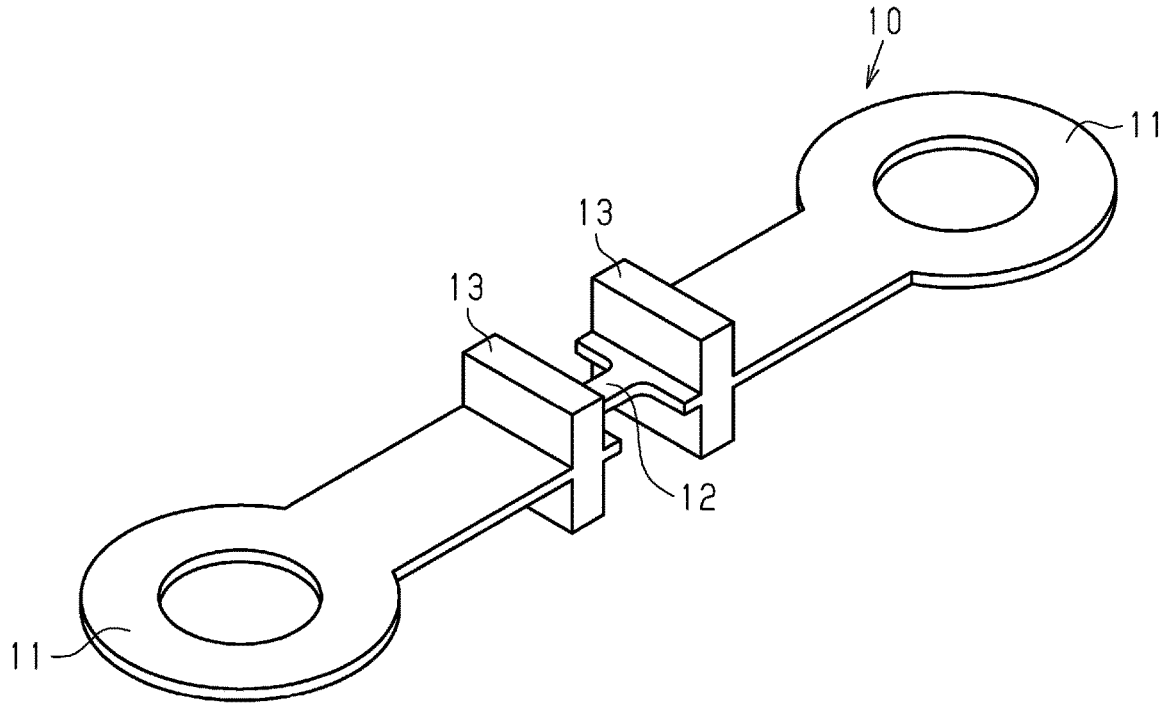
FIG. 7 is a perspective view showing the fuse element according to a first modification.

The fuse element 10 does not have to be shaped as illustrated in the first and second embodiments. For example, like a first modification shown in FIG. 7, the fuse element 10 may include two thick plates 13, which are respectively arranged at the ends of the two terminals 11 connecting to the melt portion 12. The thick plates 13 protrude toward the opposite sides of the fuse element 10 in the thickness direction.

Figure 8:
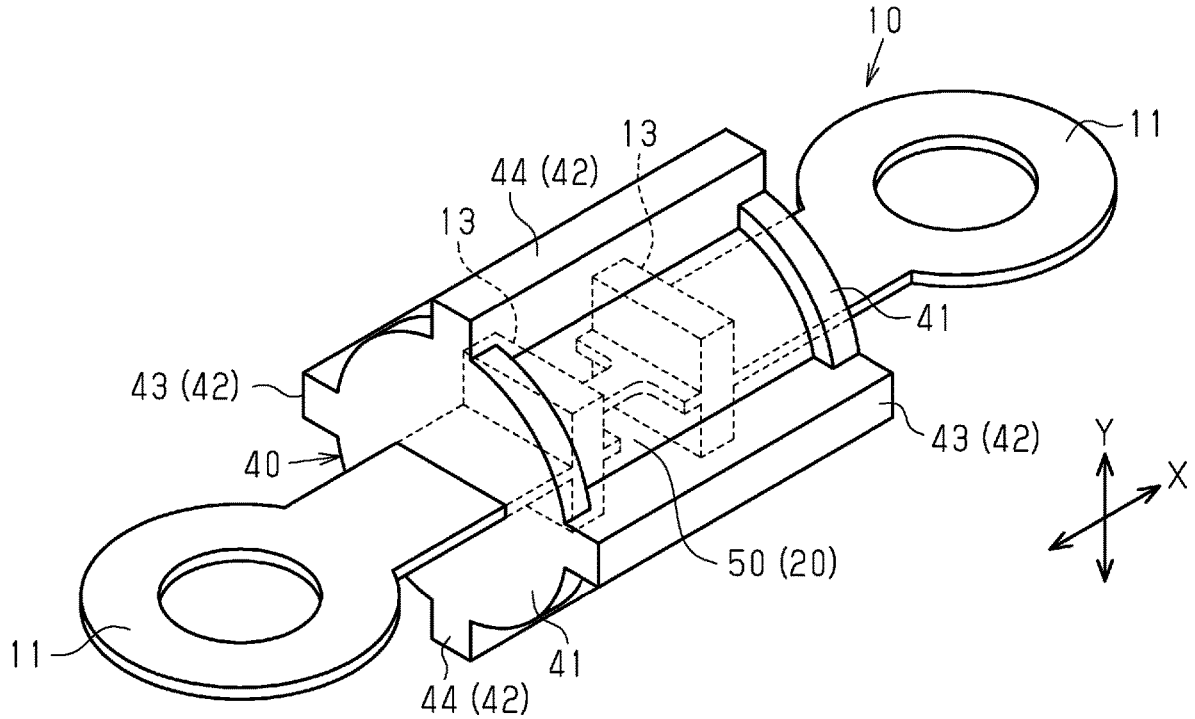
FIG. 8 is a perspective view showing the fuse according to the first modification.

In the first modification, as shown in FIG. 8, the exposed portions 50 are arranged at the parts of the outer circumferential surface of the casing 20 that correspond to the thick plates 13 (more specifically, the parts of the casing 20 overlapping the thick plates 13 in the radial direction). This increases the radiation performance of the casing 20. Additionally, such exposed portions 50 may be arranged at only the parts of the casing 20 that overlap the thick plates 13 in the radial direction.

Figure 9:
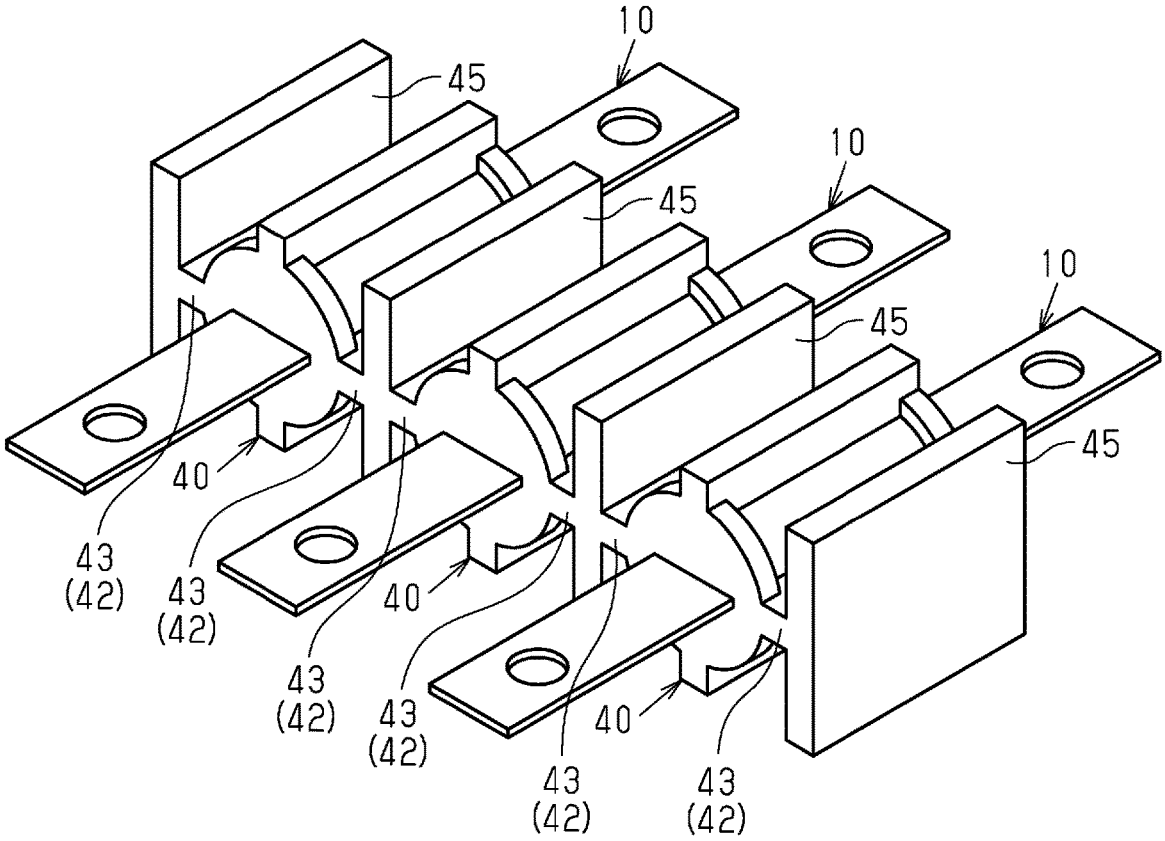
FIG. 9 is a perspective view showing the fuse according to a second modification.

Multiple fuses may be integrated with each other by the molded body 40. For example, like a second modification shown in FIG. 9, three fuse elements 10 may be laid out in the width direction to integrally form the molded body 40 having the shape as illustrated in the first embodiment. In the second modification, two first coupling portions 43 adjacent to each other are integrally molded by a coupling wall 45. Thus, the molded body 40 covering the casing 20 facilitates the integration of a fuse with another fuse or another component.

The first portion 31 does not have to include the recess 31*a*. That is, the first portion 31 may have the same shape as the second portion 32.

Figure 10:
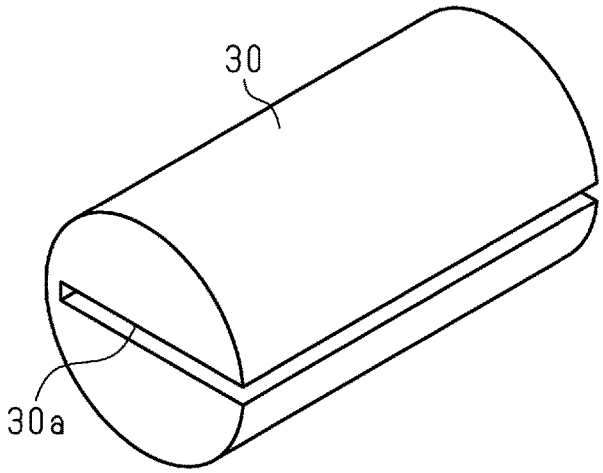
FIG. 10 is a perspective view showing the arc-extinguishing material according to a third modification.

The arc-extinguishing material 30 is not limited to the assembly of multiple segments. For example, the arc-extinguishing material 30 may be substantially columnar. In this case, like a third embodiment shown in FIG. 10, the arc-extinguishing material 30 may include a cutout 30*a*, which extends through the arc-extinguishing material 30 along the axis L and opens in the outer circumferential surface of the arc-extinguishing material 30, and the cutout 30*a* may accommodate the fuse element 10.

The arc-extinguishing material 30 does not have to be solid as illustrated in the above-described embodiments and modifications and may be powdery.

Figure 11:
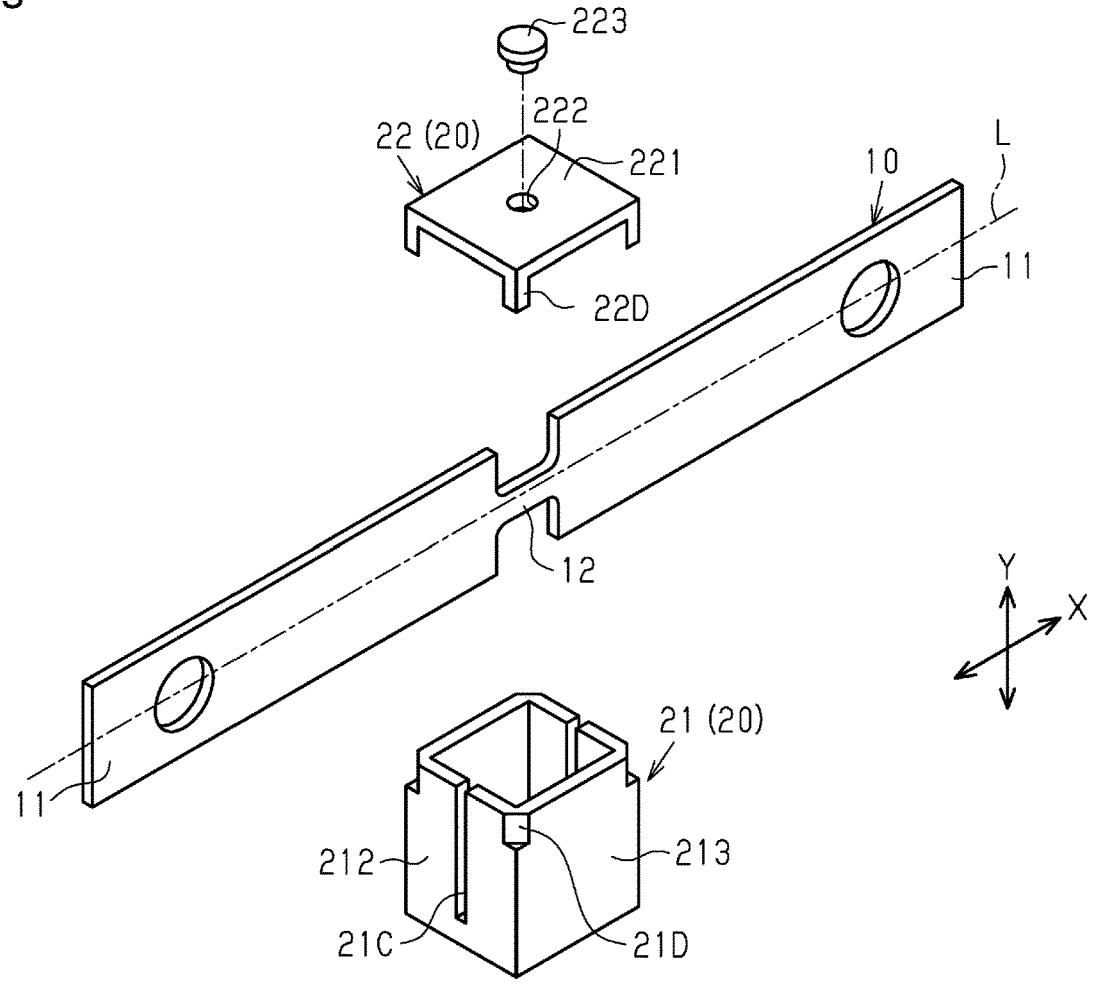
FIG. 11 is an exploded perspective view showing the internal structure of the fuse according to a fourth modification.
Figure 12:
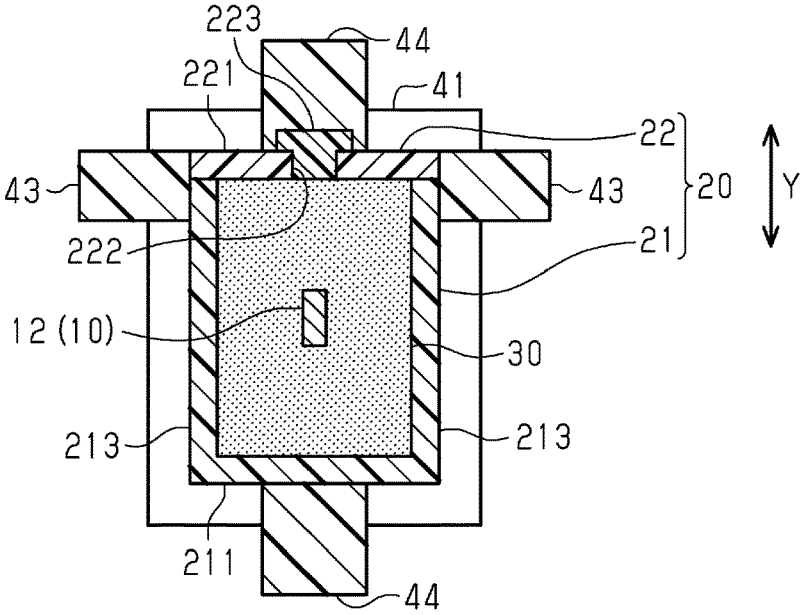
FIG. 12 is a cross-sectional view showing the fuse according to the fourth modification.

The fuse according to a fourth modification is shown in FIGS. 11 and 12. The fuse includes a powdery arc-extinguishing material 30. To manufacture this fuse, the fuse element 10 is first inserted into the first casing member 21 and two recesses 21C. Next, the second casing member 22 is coupled to the first casing member 21. Then, the casing 20 is filled with the powdery arc-extinguishing material 30 through a hole 222 in the top wall 221 of the second casing member 22. Subsequently, a plug 223 is fitted into the hole 222. Thereafter, the assembly of the fuse element 10, the first casing member 21, the second casing member 22, the plug 223, and the arc extinguishing material 30 is inserted into the mold (not shown) to inject molten resin into the cavity (not shown) in the mold. Thus, the molded body 40 is formed. In the formation of the molded body 40, the entire plug 223 is covered by the second coupling portions 44.

The casing 20 may be an assembly of three or more segments.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

The invention claimed is:

1. A fuse, comprising:

a fuse element extending along an axis, the fuse element including two terminals and a melt portion arranged between the two terminals;

a casing that accommodates the melt portion and an arc-extinguishing material, the casing including an outer circumferential surface and two end surfaces, the casing being an assembly of at least two segments; and a molded body made of plastic, the molded body including two covers that respectively cover the two end surfaces and including one or more coupling portions that couple the two covers to each other, the two covers and the one or more coupling portions being integrally molded, wherein the casing includes one or more exposed portions on the outer circumferential surface, the one or more exposed portions being exposed without being covered by the coupling portions.

2. The fuse according to claim 1, wherein the at least two segments include a first casing member and a second casing member, and each of the first casing member and the second casing member includes the exposed portions.

3. The fuse according to claim 2, wherein the one or more coupling portions include multiple coupling portions arranged at intervals in a circumferential direction around the axis.

4. The fuse according to claim 3, wherein the one or more coupling portions include two coupling portions that seal a section between the first casing member and the second casing member.

5. The fuse according to claim 4, wherein the two coupling portions are first coupling portions, and the multiple coupling portions further include two second coupling portions that respectively cover an outer circumferential surface of the first casing member and an outer circumferential surface of the second casing member.

* * * * *